United States Patent [19]

Harkins

[11] 4,446,664

[45] May 8, 1984

[54] INSULATION SYSTEM

[76] Inventor: Daniel J. Harkins, 2200 W. Norfolk Ave., Norfolk, Nebr. 68701

[21] Appl. No.: 246,209

[22] Filed: Mar. 23, 1981

[51] Int. Cl.[3] ..... E04B 1/74

[52] U.S. Cl. ..... 52/404; 52/746; 52/747

[58] Field of Search ..... 52/404, 407, 408, 406, 52/410, 743, 90, 665, 746, 747

[56] References Cited

U.S. PATENT DOCUMENTS

| | | | |
|---|---|---|---|
| 3,969,863 | 7/1976 | Alderman | 52/90 |
| 4,047,346 | 9/1977 | Alderman | 52/90 |
| 4,069,636 | 1/1978 | Kessler | 52/712 |
| 4,075,806 | 2/1978 | Alderman | 52/407 |
| 4,075,807 | 2/1978 | Alderman | 52/90 |
| 4,078,355 | 3/1978 | Clemensen | 52/665 |
| 4,125,982 | 11/1978 | Ward | 52/743 |
| 4,147,003 | 4/1979 | Alderman | 52/404 |
| 4,172,345 | 10/1979 | Alderman | 52/406 |
| 4,233,791 | 11/1980 | Kuhl et al. | 52/743 |
| 4,303,713 | 12/1981 | Clemensen et al. | 52/404 |
| 4,329,823 | 5/1982 | Simpson | 52/410 |
| 4,361,993 | 12/1982 | Simpson | 52/410 |

*Primary Examiner*—James L. Ridgill, Jr.
*Attorney, Agent, or Firm*—Zarley, McKee, Thomte, Voorhees & Sease

[57] ABSTRACT

A system for insulating the ceiling of a building includes a plurality of spaced parallel support bands suspended between opposite walls of the building in vertically spaced relation from the ceiling, a continuous independent suspension sheet of a vapor barrier material supported on the bands, a plurality of band fasteners connecting the bands to the ceiling at spaced-apart positions along the bands, and thermal insulation material supported on the vapor barrier suspension sheet.

10 Claims, 7 Drawing Figures

INSULATION SYSTEM

BACKGROUND OF THE INVENTION

The present invention relates generally to roof insulation methods and more particularly to roof insulation in metal buildings.

Metal buildings of the type conventionally used for barns, workshops and numerous industrial applications have many advantages over wood buildings, including ease of construction and low maintenance costs. Because of the rising costs of energy in recent years, it has become increasingly necessary to provide more efficient methods of insulation for metal buildings.

Conventionally, insulation for the roof of a metal building is provided by placing a layer of rolled insulation across the top of the purlins or rafters of a building prior to installing the roof. The roof is then attached to the purlins through the insulation. A problem with this method of insulation has been that the insulation must be tightly compressed between the sheeting and purlins. Compression of the insulation causes it to become less efficient at reducing heat transfer and as a result, there is a significant heat loss from the building roof in the area of the purlins. Additionally, the insulation which is rolled out over the purlins must be of limited thickness even in the area between the purlins due to the fact that it must be sufficiently compressed in the area above the purlins to allow attachment of the roof sheeting. Attempts have been made to improve the heat loss characteristics of a roof by installing pan insulation which fills the entire void between the purlins and the roof sheeting. However, this pan insulation must be supported at its lower surface. Conventional systems available for providing lower surface support of the pan insulation are time consuming to install and quite expensive. Another major problem with existing methods of insulating metal buildings is that heat is lost through the metal roof purlins by conduction to the exterior surface and thereafter through radiation. The purlins are thus cooled to a temperature much lower than that of the air in the building which causes condensation from water vapor in the air to form on the purlin surfaces. Conventional methods of insulating do not provide a positive vapor barrier below the purlins and therefore condensation problems arise.

It can, therefore, be seen that a need exists for a support system which will support insulation placed between purlins which also may function to provide a positive vapor barrier below the roof purlins. To be cost effective the system must be easily installed and must have low material and labor costs.

SUMMARY OF THE INVENTION

The present invention utilizes a grid-work of steel banding material to support a vapor barrier sheet, which in turn supports insulation material placed between purlins of a building.

Accordingly, it is a primary object of the present invention to provide an improved insulation system for use in metal buildings.

It is a further object of the present invention to provide an insulation system having a separate continuous vapor arrier.

It is a further object of the present invention to provide an insulation system which may be used in new construction or existing structures.

It is a further object of the present invention to provide an insulation system which is adaptable to pre-engineered steel buildings, bar-joist roof construction, wood beam or truss systems, wood or metal framed walls, and other types of construction.

It is a further object of the present invention to provide an insulation system which may e used for a high "R" factor insulation system.

It is a further object of the present invention to provide an insulation system wherein the material labor ratio is very high.

It is a further object of the present invention to provide an insulation system which is inexpensive to install.

It is a further object of the present invention to provide an insultion system which may be used with or without a vapor barrier sheet.

It is a further object of the present invention to provide an insulation system which may be used with a fire retardant vapor barrier material.

It is a further object of the present invention to provide an insulation system which may be used with roll or batt insulation, including fiberglass and rock wool insulation material.

It is a further object of the present invention to provide an insulation system which may utilize blown in insulation of various types.

It is a further object of the present invention to provide an insulation system which requires no special installation tools.

It is a further object of the present invention to provide an insulation system which is installed with the suspension system and vapor barrier at the lower side of a purlin or joist.

It is a further object of the present invention to provide an insulation system which is esthetically pleasing in appearance.

It is a further object of the present invention to provide an insulation system which may be used as an exposed finished ceiling.

It is a further object of the present invention to provide an insulation system which may be installed in very cold temperatures without splitting or cracking of the suspension material.

It is a further object of the present invention to provide an insulation system which may be installed under windier conditions than conventional steel building insulation.

It is a further object of the present invention to provide an insulation system which has materials which are extremely tough and durable and resistant to most chemical salts and acids.

It is a further object of the present invention to provide an insulation system which may be fitted into existing buildings at lower costs than conventional systems.

It is a further object of the present invention to provide an insulation system which may be installed either before or after the roof is installed.

It is a further object of the present invention to provide an insulation system which may be installed by construction crews without any special training or experience.

It is a further object of the present invention to provide an insulation system which provides a light reflective lower surface.

It is a further object of the present invention to provide an insulation system in which roof leaks can be easily detected and located for ease of repair.

It is a further object of the present invention to provide an insulation system with a minimum of seams in the vapor barrier material when used.

It is a furher object of the present invention to provide an insulation system which eliminates the lamination process required to laminate sheets of vapor barrier material to fiberglass insulation.

It is a further object of the present invention to provide an insulation system which does not obstruct the bottom side of the roof structural members and interfere with attachment of mechanical and electrical apparatus.

It is a further object of the present invention to provide an insulation system which is also adaptable for use in building walls.

It is a further object of the present invention to provide an insulation system with an air film between the vapor barrier and the insulation.

DESCRIPTION OF THE PREFERRED EMBODIMENTS

Figure 1:
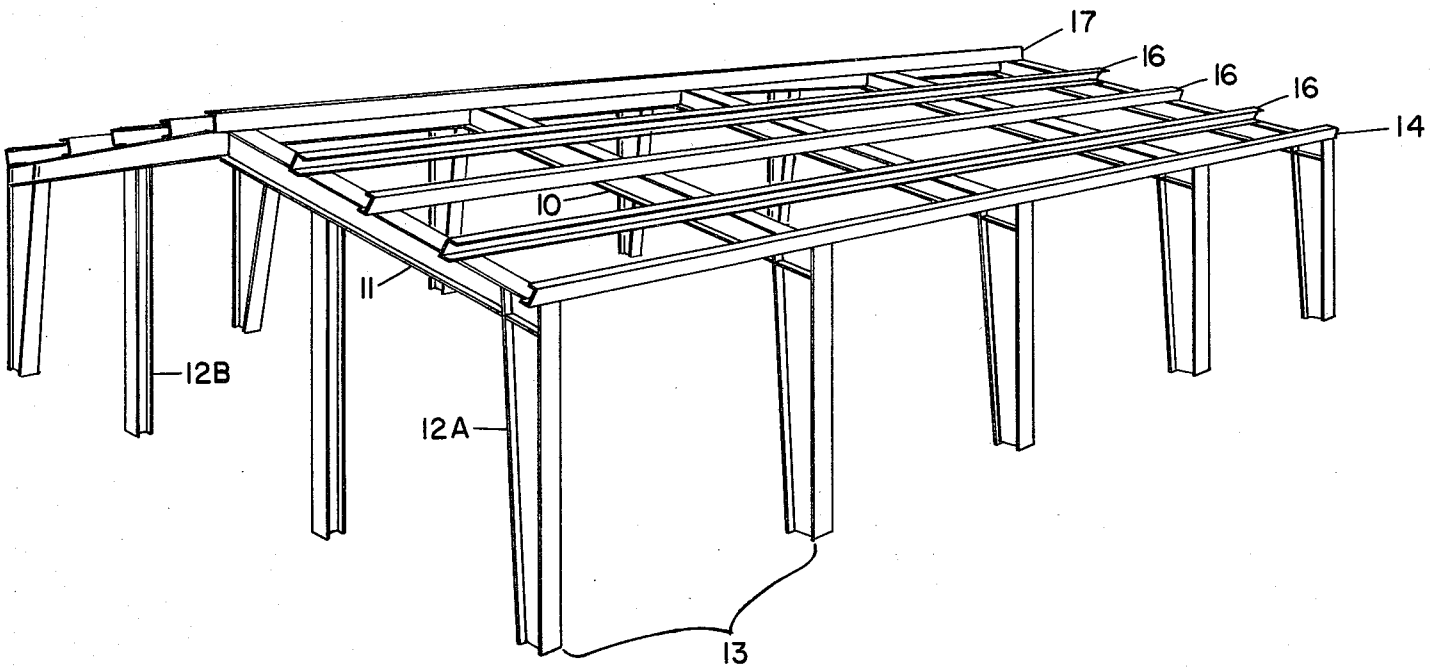
FIG. 1 is a perspective view of a typical metal building structure.
Figure 4:
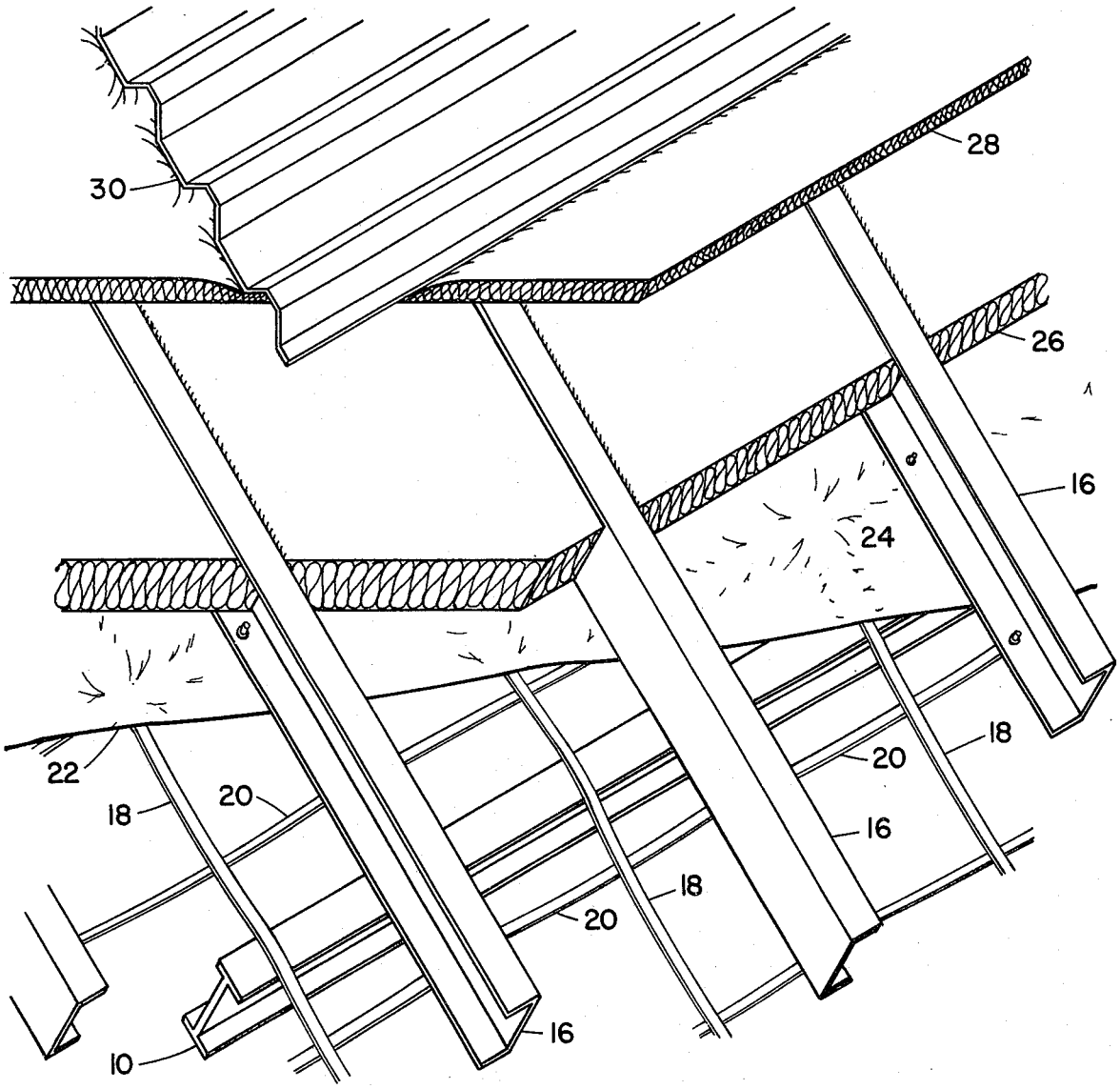
FIG. 4 is a cutaway perspective view showing sheet roofing insulation material, support sheet and support band grid-work and fasteners.
Figure 5:
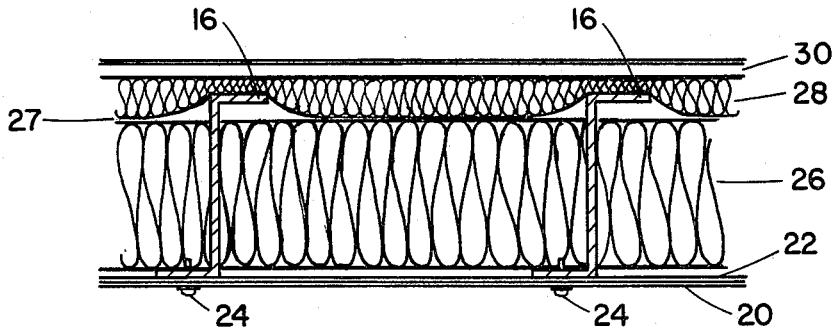
FIG. 5 is a detail elevation view showing "Z" purlins with double insulation.

The structural members of a typical metal building are shown in FIG. 1. It can be seen that vertical support for the roof is provided by rafter columns 12 positioned along the side walls of the building, end wall corner columns 12A, positioned at the corners of the building, and end wall columns 12B, positioned in the end walls of the building. Rafters 10, positioned at the top of the columns 12, 12A, and 12B span the building transversely creating a series of open spaces between rafters 10, commonly referred to as "bays" 13 in the construction arts. Eave struts, 14, positioned at the end of the rafters 10, run the length of the building wall and provide lateral support between columns 12,12A. Purlins 16, attached to the upper surface of the rafters 10, are placed in spaced parallel arrangement and run the length of the building between end wall rafters 11. Both "C" shaped and "Z" shaped purlins 16, as shown in FIGS. 4 and 5 respectively, are commonly used in the construction arts. Both types of purlins 16, as well as bar-joists (not shown) which are sometimes used instead of purlins, are compatible with the method and apparatus of the present invention.

Figure 2:
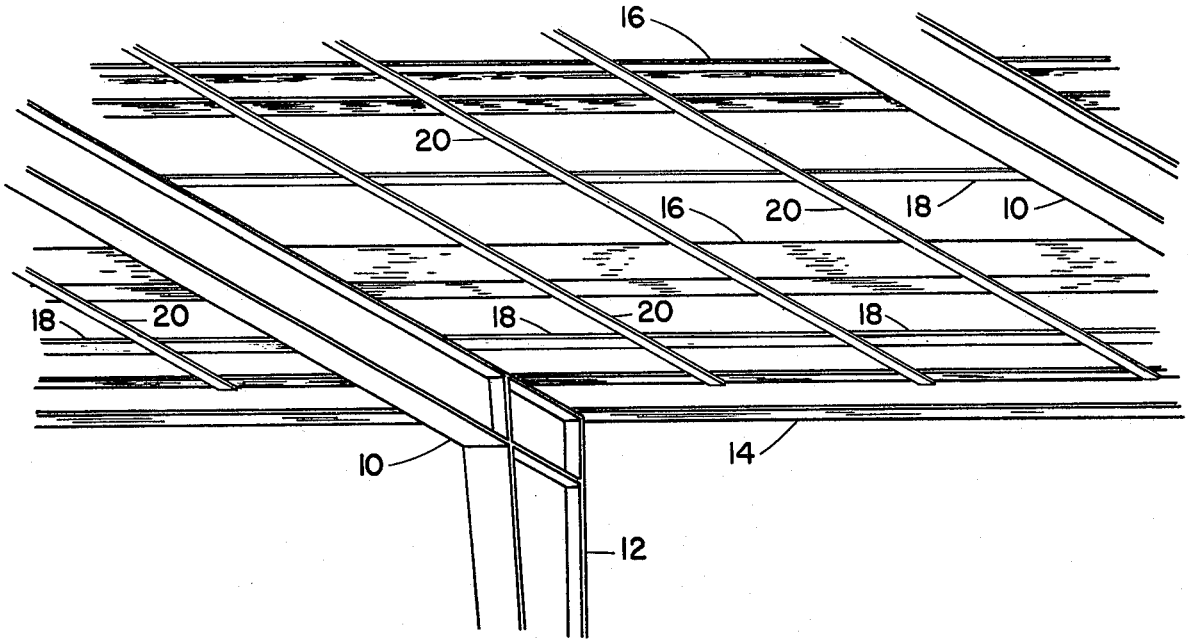
FIG. 2 is a perspective view showing a support band gridwork.
Figure 3:
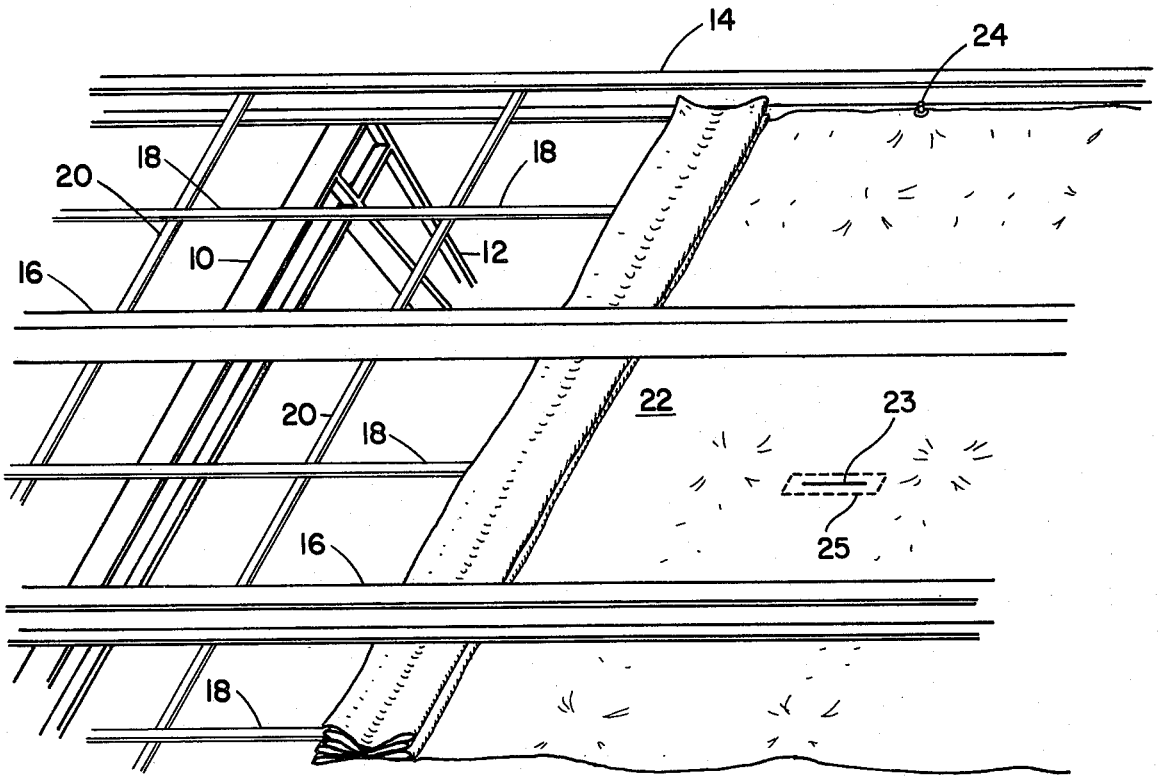
FIG. 3 is a perspective view showing a support band gridwork with a partially placed support sheet.
Figure 6:
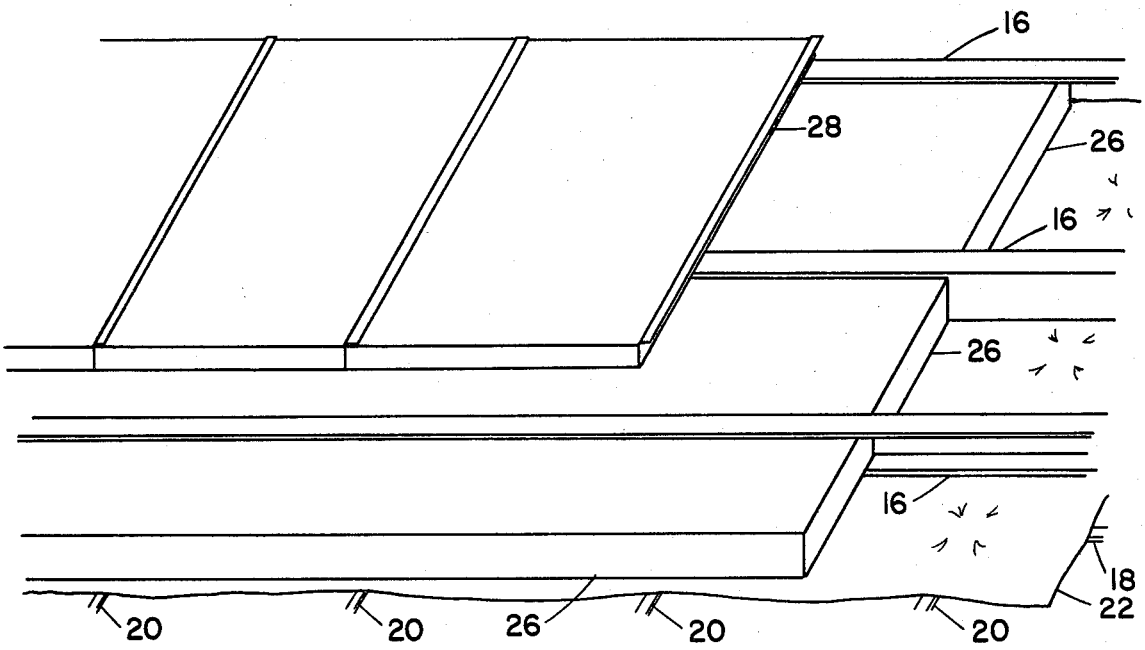
FIG. 6 is a cutaway perspective view showing double insulation placement.

As shown in FIG. 2, the apparatus of the present invention includes a grid-work formed from steel. Longitudinal bands 18 and steel transverse bands 20. The bands 18,20 are supported by various structural members and define a plane parallel to the lower surface of the purlins 16. The bands 18,20 support a high strength sheet support material 22, as shown in FIG. 3. The support material 22 in the preferred embodiment also serves as a vapor barrier. Pan insulation blocks 26 are positioned between the purlins 16 and supported by the vapor barrier sheet 22, as shown in FIGS. 4 through 7. Rolled insulation material 28 is rolled transversely across the tops of the purlins 16, as shown in FIGS. 5 and 6. An air gap 27, created between the rolled insulation 28, provides a dead air space which increases the insulating effectiveness of the structure. Roofing material 30 is attached above the upper insulating material 28. In the preferred embodiment the roofing material 30 is shown to be a corrigated sheet metal, however, numerous types of roof sheeting may be employed and are compatible with the invention.

The installation of the suspension system will now be described. Longitudinal metal bands 18 are suspended from end wall 11 to end wall 11 perpendicular to the main rafters 10. The number of longitudinal bands 18 to be used is dependent on spacing of the purlins 16. The simplest case is depicted in the preferred embodiments where only a single band 18 is positioned between each pair of purlins 16. However where the purlin spacing is wider, numerous bands 18 may be required and are spaced at distances of equal proportions between each set of purlins 16. The longitudinal bands 18 are placed over the top of each rafter 10 and generally need to be rigidly attached only at the upper surface of the end wall rafters 11. However, where the building is extremely long, it may be necessary to attach the bands 18 to the upper surface of one or more intermediate rafters 10. The bands 18 are fastened to the upper surface of the end rafters 11 (and if necessary, to intermediate rafters 10) by conventional attachment means. However, in the preferred embodiment, self-drilling or self-tapping metal sheeting fasteners (not shown) are used to increase the speed of the installation. The longitudinal bands 18 must not be allowed to sag between rafters 10 and, therefore, it may be necessary to use a band attachment tool and splice clips (not shown) to produce tension in the bands 18.

Transverse bands 20 are installed after the longitudinal bands 18 are in place. These bands 20 are first attached to the bottom edge of each eave strut 14 on one side of the building. The bands are then pulled tight to minimize sag and are attached to the bottom of the eave strut 14 on the opposite side of the building. The number of transverse bands 20 to be used will, of course, vary with the distance between rafters 10. In new structures three equally spaced bands per bay 13 are most efficient but the maximum distance between traverse bands 20 should not exceed seven feet. At the completion of the installation process, the transverse bands 20 are attached to the purlins 16 and provide vertical support to the longitudinal bands 18. No transverse bands 20 are required to the immediate area of the rafters 10 since the longitudinal bands 18 lay over the rafters 10 and are supported by the rafters 10 at that point. In buildings with a flat roof, the length of each transverse band 20 is approximately the width of the building between eave struts 14. However, where the building has a gabled roof, the transverse bands 20 must be long enough to accomodate the extra width of the roof occasioned by the upward inclination of the roof. Since the transverse bands 20 are installed below the longitudinal bands 18 and are unsupported except at the eave struts 14, a noticeable sag will be present in the bands 20 initially. In cases where the building is over 80 feet wide, or where the gable of the building is extremely high, it is recommended that the transverse bands 20 be installed in two sections running from each eve strut 14 to the ridge 17.

The suspension material 22, which in the preferred embodiment consists of a vapor barrier material, is trimmed to size before installation. The suspension material 22 is installed one bay 13 at a time and, in the case of large buildings or buildings with high gables, the material 22 for each half of the bay divided by the ridge 17 is installed separately.

After the suspension material 22 has been cut to a size having a dimension a few inches longer than the dimensions of the bay 13 to be covered, it must be folded for easy spreading above the bands 18 and 20. For this purpose a zig zag type fold, as shown in FIG. 3, has proven to be the easiest to work with, although other rolling or folding arrangements could also be used and are within the scope of the invention. After the suspension material 22 has been folded to a convenient size, it is lifted up and laid across the top of the longitudinal band 18 system. The suspension material 22 is then unfolded on top of the bands 18 and pulled into position. Care should be taken to remove wrinkles prior to permanent attachment of the material 22. After the suspension material 22 has been properly positioned, it is glued or stapled at the eave struts 11 and rafters 10. A band fastener 24 is then used to attach each transverse band 20 and associated purlin 16 at the point where the transverse bands 20 and purlins 16 intersect. The fastener 24 also passes through the suspension material 22 and has the effect of holding it in a fixed position with respect to the band grid-word. At this point the installation of the suspension system for a particular bay 13 is complete. Installation of insulating material 26,28 and roof sheeting 30, as more fully described below, takes place immediately after the placement of the suspension material 22 in each bay 13, with each bay 13 being completed before proceeding to the next bay 13.

Figure 7:
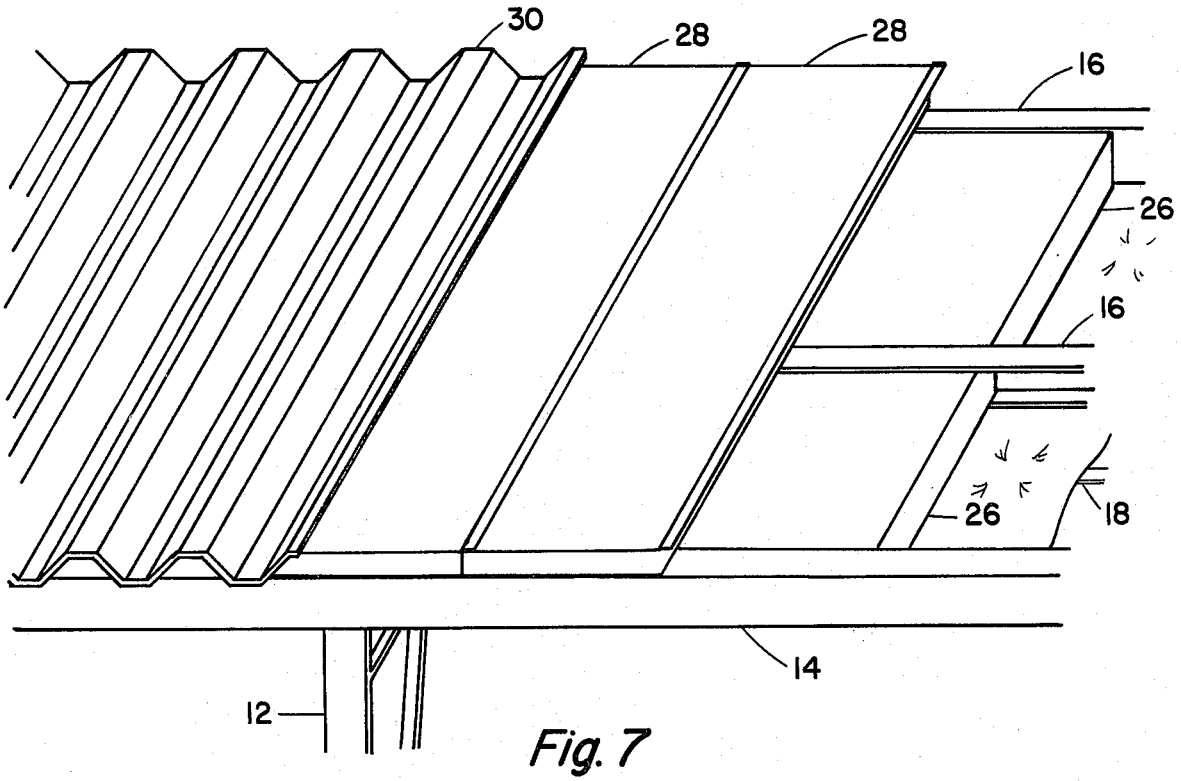
FIG. 7 is a cutaway perspective view showing single insulation placement and roof sheeting placement.

A number of options exist for installation of insulating materials. In the preferred embodiment pan insulation 26 is installed between each pair of purlins 16. Since the roof is open, the pan insulation 26 may be laid into the area between purlins 16 from above. Pan insulation 26, having a sufficient width and depth to fill the entire area between the purlins 16 and the suspension material 22, should be used for maximum insulating effect. It is then possible to install roof sheeting material 30 directly on top of the purlins 16, as shown in FIG. 7. This allows direct attachment of the roofing material 30 to the purlins 16 and provides greatly improved heating efficiency over conventional systems. However, additional insulating benefits are achieved by installing a second layer of insulation 28 over the tops of the purlins 16 and pan insulation 26. A dead air gap 27 is thus formed between insulating layers which further enhances the insulating effect, thereby increasing the heat retention of the building. The second insulating layer 28 is generally applied in transverse strips, using roll insulation, as shown in the cutaway drawing in FIG. 6. In this case, the roofing material 30 must be attached to the purlins 16 through the second layer of insulation material 28. This may be accomplished either by compressing the insulating material 28 in the area of the purlins 16 or by providing "stand off" roof fasteners (not shown) to hold the sheeting material 30 a fixed distance from the purlins 16. In a situation where a second insulating layer 28 is not used, a simple thermal brake material (not shown) is applied at the top and/or bottom of each purlin 16 and eave strut 14 prior to attachment of roofing material 30. This prevents direct conduction of heat through the metal surface of the purlins 16 and roof 30.

Essentially the same method may be used for installing insulation in a previously constructed building. The band gridwork 18,20 and suspension material 22 are installed in exactly the same way. However, due to the fact that the roof 30 has already been placed, pan material 26 and an upper insulation layer 28 may not be used. In its place, particulate or foam fiberglass or mineral wool insulation is blown into the void between the roof 30 and the suspension material 22. In order to blow the material in, a small slit (not shown) is made in the suspension material 22 between each set of purlins 16 in each bay 13, or every other bay 13, depending upon how far the insulation may be blown. After each space is filled, a sealing tape (not shown) is applied over the access slit (not shown) to prevent the loss of the insulating material. Although this method is used primarily in buildings which have already een completed, it may also be used in new buildings, especially when weather conditions make it desirable to quickly cover the roof to afford enclosed working space.

In some situations, especially those encountered when installing insulation in a previously constructed building, the longitudinal bands 18 may entirely be eliminated and transverse bands 20 are used exclusively. The transverse bands 20 are installed exactly as described above and an increased number of bands 20 are used to provide needed support. It is recommended when only transverse bands 20 are being used that the bands 20 be spaced a maximum distance of 24 inches apart. The remaining installation steps are then completed as described above, depending on the particular characteristics of the building. Although the above description has been directed to buildings of a type employing rafters and columns as primary structural members, the system is adaptable to any roof construction employing structural cross members to support the roof. For instance, in a masonary building with all bar-joist construction, the barjoist may span the entire width of the building and bear directly on the masonary walls. In this situation, the bar-joists are equivalent to the purlins and the suspension system is installed on the bottom plane of the bar-joists. With masonry walls, there are no eave struts or end beam rafters and installation of a support such as angle iron near the upper edge of the walls is required. The angle iron then serves the same purpose as the eave struts and end beam rafters in attaching the band gridwork.

Although specific components and steps have been stated in the above description of the preferred embodiments of the invention, other suitable materials, and process steps may be used with satisfactory results with varying degrees of quality. In addition, it will be understood that various other changes of the nature of the invention will occur to and may be made by those skilled in the art, upon the reading of this disclosure. Such changes are intended to be included within the principles and scope of this invention as claimed.

I claim:

1. A suspension system for insulation of a building roof of the type comprised of two transverse end wall rafters supported by end wall corner columns, transverse rafters supported by rafter columns, longitudinal eave struts operably attached to the ends of said rafters, longitudinal beams positioned in parallel spaced relationship and operably attached to the upper surface of said rafters and roof sheeting material operably attached to the upper surface of said beams wherein the suspension system comprises:

(a) spaced longitudinal metal bands suspended between the end wall rafters in touching contact with the upper surfaces of the transverse rafters;

(b) spaced transverse metal bands suspended between the eave struts below said longitudinal bands;

(c) transverse band fasteners means for attaching said transverse bands to the beams whereby said transverse bands and said longitudinal bands form a suspension grid-work;

(d) an independent suspension sheet means, comprising a vapor barrier material, operably positioned between said suspension grid-work, and the beams, said suspension sheet means extending longitudinally from one rafter to another and transversely from one eave strut below a plurality of longitudinal beams, said suspension sheet means being continuous but for the passage of said band fastener means therethrough, thereby separating said beams and rafters from the space below said suspension sheet means; and (e) first insulation means positioned between the beams and below the roof sheeting material and operably supported on said suspension sheet means.

2. The suspension system of claim 1 wherein said longitudinal bands and said transverse bands are in sufficient tension to be substantially coplanar with the lower surfaces of the beams.

3. The suspension system of claim 2 wherein said first insulation means comprises blown in insulation.

4. The suspension system of claim 3 wherein said first insulation means comprises roll insulation.

5. The suspension system of claim 3 wherein said first insulation means comprises batt insulation.

6. The suspension system of claim 3 wherein said first insulation means comprises sheet insulation.

7. The suspension system of claim 6 further comprising second insulation means positioned above the beams and below said roof sheeting material.

8. The suspension system of claims 2 or 7 wherein said longitudinal bands comprise steel bands of a type used for binding factory crates.

9. A method of installing insulation, during construction, in a building roof of the type comprised of two transverse end wall rafters, transverse rafters arranged between said end wall rafters and defining individual rafter bays between said rafters and end wall rafters, longitudinal eave struts operably attached to the ends of said rafters and longitudinal beams positioned in parallel spaced relationship and operably attached to the upper surface of said rafters, comprising the steps of:

(a) extending a series of metal bands, positioned in spaced-apart parallel relationship, longitudinally across the upper surfaces of a building's rafters and end wall rafters;

(b) attaching the ends of said longitudinal bands to the upper surfaces of said end wall rafters;

(c) tightening said longitudinal bands to eliminate sag between the rafters;

(d) suspending a series of metal bands, positioned in spaced parallel relationship, transversely across the building by:

(i) attaching one end of each transverse band to the lower surface of one eave strut;

(ii) attaching the other end of each transverse band to the lower surface of the opposite eave strut; and (iii) tightening each transverse band to a length approximately equal to the distance transvered by each rafter between said eave struts, whereby a band grid-work is formed by said transverse and longitudinal bands, (e) providing a continuous independent sheet suspension material having a width at least equal to the width of a rafter bay and having a length slightly greater than the length of said rafter bay, said suspension material comprising a vapor barrier;

(f) positioning said suspension material on said longitudinal bands;

(g) spreading out said continuous sheet suspension material to completely cover said band grid-work within said rafter bay;

(h) attaching the edges of said suspension sheet to said rafters and eave struts;

(i) tightening each transverse band against the lower surface of said suspension sheet by attaching said transverse bands to said beams, at associated intersection points through said suspension sheet;

(j) supporting first insulation material in the voids created by said suspension sheet and said beams;

(k) covering the upper surfaces of said beams and said first insulation material with second insulation material; and (l) attaching roofing material to said beams through said second insulation material.

10. A method of installing insulation in the roof of a building of the type comprised of two transverse end wall rafters, transverse rafters arranged between said end wall rafters and defining individual rafter bays between said rafters and end wall rafters, longitudinal eave struts operably attached to the ends of said rafters and longitudinal beams positioned in parallel spaced relationship and operably attached to the upper surface of said rafters, and roof sheeting operably attached to the upper surface of said beams, subsequent to the laying of the roof sheeting, comprising the steps of:

(a) extending a series of metal bands, positioned in spaced parallel relationship, longitudinally across the upper surfaces of a building's rafters and end wall rafters;

(b) attaching the ends of said longitudinal bands to the upper surfaces of said end wall rafters;

(c) tightening said longitudinal bands to eliminate sag between the rafters;

(d) suspending a series of metal bands, positioned in spaced parallel relationship, transversely across the building by:

(i) attaching one end of each transverse band to the lower surface of one eave strut;

(ii) attaching the other end of each transverse band to the lower surface of the opposite eave strut; and (iii) tightening each transverse band to a length approximately equal to the distance transversed by each rafter between said eave struts, whereby a band grid-work is formed by said transverse and longitudinal bands, (e) providing a continuous independent sheet suspension material having a width at least equal to the width of a rafter bay and having a length slightly greater than the length of said rafter bay, said suspension material comprising a vapor barrier;

(f) positioning said suspension material on said longitudinal bands;

(g) spreading out said continuous sheet suspension material to completely cover said band grid-work within said rafter bay;

(h) attaching the edges of said suspension sheet to said rafters and eave struts;

(i) tightening each transverse band against the lower surface of said suspension sheet by attaching said transverse bands to said beams, at associated intersection points through said suspension sheet;

(j) providing at least one slit in said suspension sheet between each pair of beams;

(k) blowing insulation material through said slits into the voids formed by said suspension sheet, said roof sheeting and each pair of beams; and (l) sealing said slits.

* * * * *